United States Patent [19]

Kabchef

[11] 3,952,448

[45] Apr. 27, 1976

[54] TOY AIRPLANE

[76] Inventor: Robert G. Kabchef, 217 Donna Lyn Drive, Smyrna, Ga. 30080

[22] Filed: Sept. 26, 1974

[21] Appl. No.: 509,436

[52] U.S. Cl. ..... 46/78; 46/79

[51] Int. Cl.[2] ..... A63H 27/00

[58] Field of Search ..... 46/76 R, 77, 78, 79, 46/80, 81, 116; D34/15 HH, 4 R; 40/37.1; 244/153 R, 154

[56] References Cited

UNITED STATES PATENTS

| | | | |
|---|---|---|---|
| 1,624,018 | 4/1927 | Slater | 40/37.1 |
| 2,744,702 | 5/1956 | Briggs | 244/154 |
| 2,814,907 | 12/1957 | Sears | 46/74 R X |
| 3,581,432 | 6/1971 | Bass | D34/15 HH |

*Primary Examiner*—Louis G. Mancene
*Assistant Examiner*—Jack Q. Lever
*Attorney, Agent, or Firm*—Jones, Thomas & Askew

[57] ABSTRACT

The toy airplane includes a paraglide wing positioned over a fuselage, and a flat connecting structure shaped in the form of a lifelike being is mounted on the fuselage and connects the paraglide wing to the fuselage. A propeller is rotatably supported at the forward end of the fuselage and its axis of rotation is inclined downwardly with respect to the paraglide wing and fuselage.

6 Claims, 3 Drawing Figures

TOY AIRPLANE

BACKGROUND OF THE INVENTION

Mass production of toy airplanes for sale to children is a low profit industry and is highly competitive. The inexpensive toy airplanes usually have been made of balsa wood or plastic at low production costs so that the product can sell at retail to the consumer at a low price. The toy airplanes have usually included a stick fuselage, balsa wood wing and tail assemblies, a propeller, and a rubber band for turning the propeller. While toy airplanes have been inexpensive to purchase by the retail customer, the toy airplanes usually do not function very well, they are not particularly eye appealing, and they are easily destroyed.

SUMMARY OF THE INVENTION

Briefly described, the present invention comprises a toy airplane that includes a paraglide wing mounted high over a stick fuselage with a flat lifelike or cartoon character mounted on the fuselage and extending upwardly into the paraglide wing, so that the paraglide wing is connected to the fuselage by the lifelike figure. The rigid portion of the paraglide wing is angled upwardly in a forward direction with respect to the fuselage, and a propeller mounted on the forward portion of the fuselage is angled downwardly in a forward direction with respect to the fuselage. The center of gravity of the toy airplane is placed well below and slightly forward of the center of lift of the paraglide wing so that the toy airplane is highly stable in flight and tends to glide for long distances during and after the time when power is applied to the propeller.

Thus, it is an object of the present invention to provide a durable, attractive and functional toy airplane for use by children and others.

Other objects, features and advantages of the present invention will become apparent upon reading the following specification, when taken in conjunction with the accompanying drawings.

DETAILED DESCRIPTION

Figure 1:
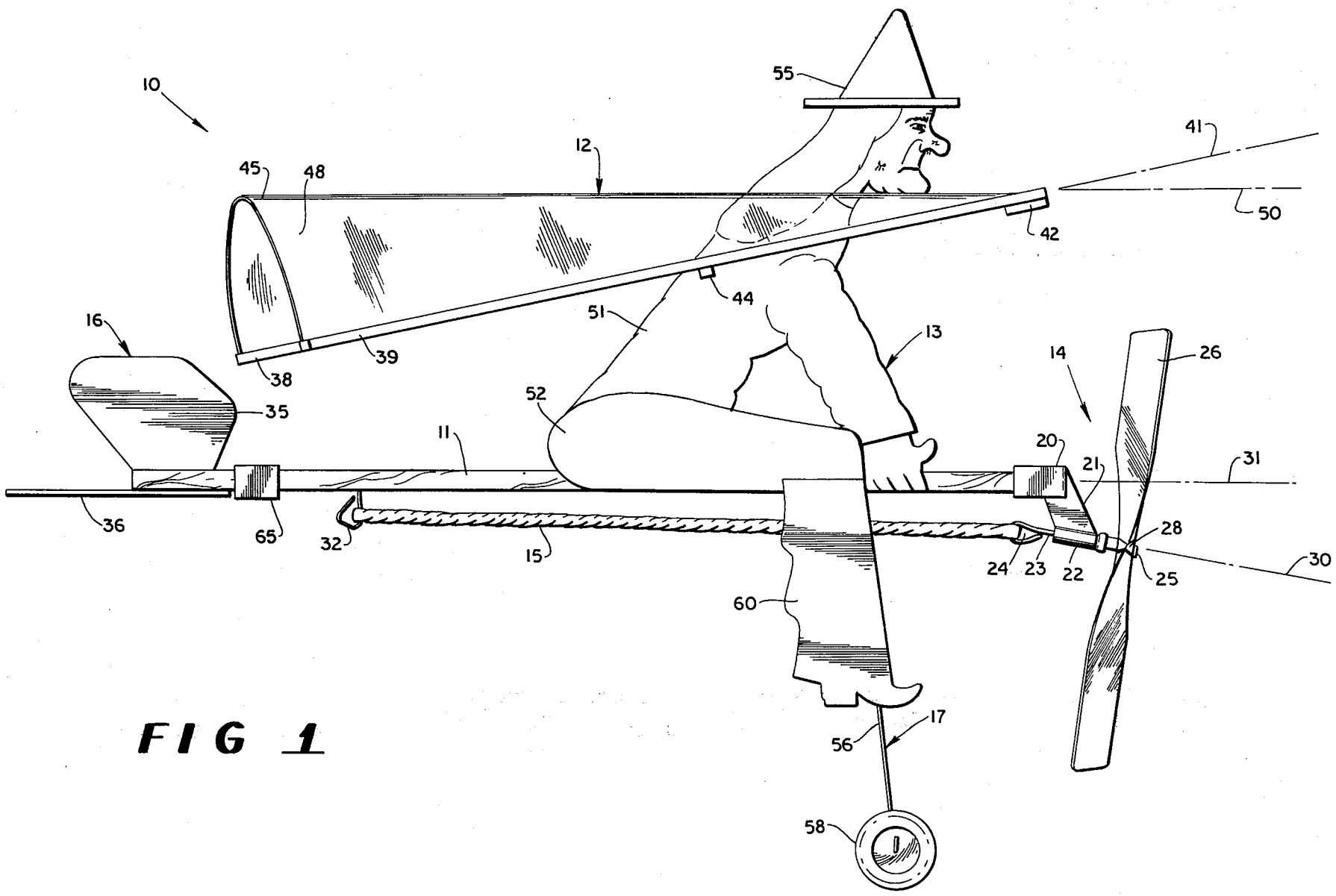
FIG. 1 is a side elevational view of the toy airplane.
Figure 2:
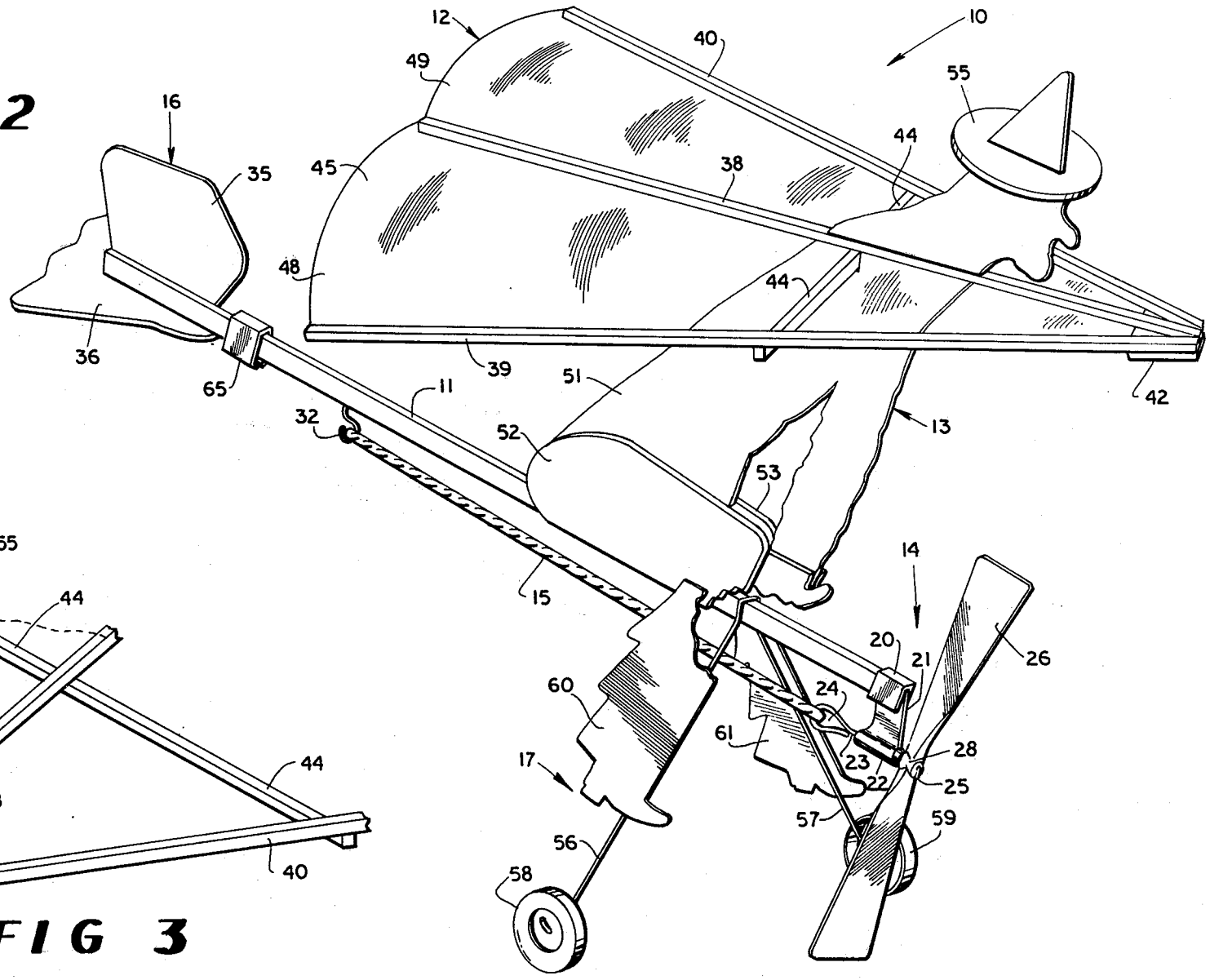
FIG. 2 is a perspective view of the toy airplane.
Figure 3:
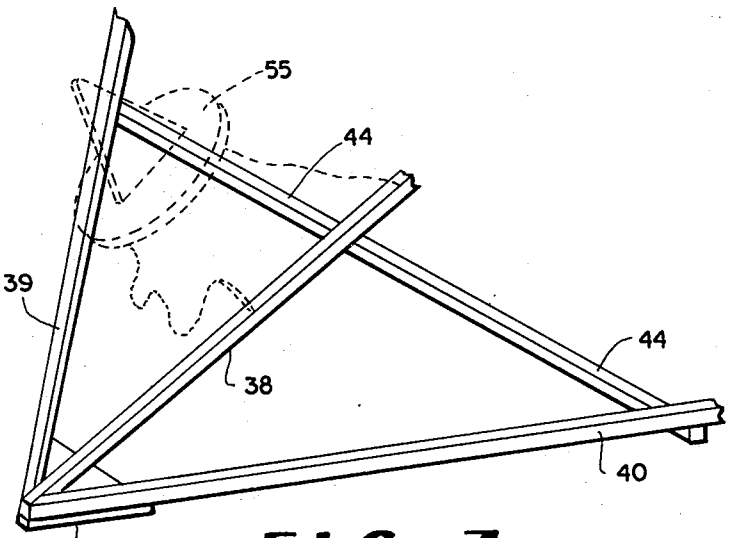
FIG. 3 is a detail illustration of the forward portion of the paraglide wing.

Referring now in more detail to the drawing, in which like numerals indicate like parts throughout the several views, FIG. 1 discloses a toy airplane 10 which includes a fuselage 11, a paraglide wing 12, a connecting structure 13 connected between the fuselage 11 and paraglide wing 12, propeller assembly 14, propeller power means 15, tail assembly 16, and landing gear 17. Fuselage 11 is a rectilinear stick structure. Propeller assembly 14 is mounted on the forward end of fuselage 11 and includes a nose piece 20 defining a socket (not shown) which extends over the forward end of the fuselage, a downwardly extending web 21 and sleeve 22. Pin 23 extends through the opening of sleeve 22 and includes an eye 24 at one end and its other end 25 is bent at an angle. Propeller 26 includes a central opening 28 and pin 23 extends through the opening with its angled end 25 protruding through the opening of the sleeve 22. The opening in sleeve 22 is angled downwardly in a forward direction with respect to the fuselage 11, as indicated by the longitudinal centerline 30 of sleeve 22 and the longitudinal centerline 31 of fuselage 11. Propeller power means 15 comprises a rubber band connected at one of its ends to the eye 24 of pin 23, and at its other end to eye hook 32 mounted on fuselage 11. The rubber band extends beneath the rectilinear fuselage 11. Thus, when the propeller 26 is wound with respect to the fuselage and then released, the air movement from the propeller with respect to the fuselage will be rearwardly and upwardly.

Tail assembly 16 comprises vertical stabilizer or rudder 35 and horizontal stabilizer 36. Stabilizers 35 and 36 are secured to the rear portion of fuselage 11 by means of a conventional adhesive.

Paraglide wing 12 includes a frame or rigid portion that comprises center spar 38 and side spars 39 and 40. Center spar 38 is positioned above and in approximately the same vertical plane as fuselage 11 and is angled upwardly in a forward direction with respect to the fuselage, as indicated by the longitudinal centerline 41 of the center spar 38. Side spars 39 and 40 are located in the same plane as center spar 38, and side spars 39 and 40 are connected together at their forward ends to the forward end of center spar 38 and diverge at equal angles rearwardly on opposite sides of center spar 38. Gusset 42 is adhesively secured to the bottom surfaces of the forward ends of center and side spars 38, 39 and 40, forming a rigid and durable connection at this point. Cross brace 44 is connected at its ends to lower surfaces of side spars 39 and 40 and at its center portion to the lower surface of center spar 38. Flexible sheet material 45 is adhesively secured to the upper surfaces of center and side spars 38, 39 and 40. The side edges of the sheet material normally are cut at a larger angle than the angle between side spars 39 and 40, so that when the side edges of the sheet material are secured to side spars 39 and 40, substantial slack is present in the sheet material, as indicated in the drawing. The amount of slack in the sheet material on opposite sides of center spar 38 should be equal. The sheet material on opposite sides of the flexible wing forms wing segments 48 and 49, and the top surfaces of the two flexible wing segments 48 and 49 when inflated will be approximately parallel to the center line 31 of fuselage 11, as indicated by construction line 50 in FIG. 1.

Connecting structure 13 is secured to fuselage 11 and the center spar 38 of paraglide wing 12. In the embodiment illustrated, connecting structure 13 is formed in the shape of a lifelike figure or witch and includes center segment 51 mounted directly on the top surface of fuselage 11 and secured to the bottom surface of center spar 38 by an adhesive. The center segment includes the witch's body and arms. Side segments 52 and 53 are secured to the opposite side surfaces of fuselage 11 and form the thigh and hands of the witch figure. The connecting structure, including both the center segment 51 and the side segments 52 and 53, is substantially flat and extends in a plane or in planes substantially parallel to the fuselage 11 and the center spar 38. A projection 55 of the lifelike figure is mounted on the upper surface of center spar 38 by means of an adhesive and forms the upper or head portion of the lifelike figure. The projection 55 is located rearwardly from gusset 42 of the paraglide wing so that the side spars 39 and 40 of the paraglide wing tend to protect the projection 55 as well as the connecting structure 13 from impact with vertical obstructions that might be encountered in flight or upon landing of the toy airplane.

Landing gear 17 is formed from a piece of bent wire which extends over fuselage 11 and then downwardly and outwardly to form the struts 56 and 57 of the landing gear. The wire is bent outwardly and then upwardly as it extends through the openings of the wheels 58 and 59 to hold the wheels on the wire. The side segments 52 of the connecting structure 13 covers the upper bend in the wire of the landing gear, and the adhesive used to connect the side segments 52 to the fuselage 11 also tends to rigidify the upper portion of the landing gear.

Leg elements 60 and 61 of the lifelike figure are attached to the struts of the landing gear and to the lower portion of the side segments 52 and 53 of the connecting structure 13. The leg elements 60 and 61 can be formed from rigid material or from flexible material. The rubber band that forms the propeller power means 15 extends between the leg elements and struts.

The fuselage 11, tail assembly 16 and the rigid portions of the paraglide wing 12 can be formed from various semirigid material, such as balsa, spruce, or plastic, and the sheet material of the paraglide wing can be formed from various lightweight sheet material, including polyethylene or any other suitable material. The nose piece and propeller of the propeller assembly and the wheels will usually be fabricated from various harder plastics, the pin 23 of the propeller assembly, pin 32 and landing gear 17 fabricated from any of the durable materials, such as steel.

While the connecting structure 13 has been illustrated as being a single sheet of material to form the center segment 51 and two sheets to form the side segments 52, it will be understood that two sheets can be utilized to form the entire connecting structure with the sheets being secured to opposite sides of fuselage 11 and opposite sides of center spar 38, or a single sheet can be used to form the connecting structure 13, with the upper and lower edges of the connecting structure being adhesively secured to the lower surface of center spar 38 and the upper surface of fuselage 11. Other arrangements compatible with the fuselage arrangement and with the paraglide arrangement can be used, as may be desired.

When the propeller 26 is wound and the toy airplane launched, the propeller will thrust air rearwardly and upwardly with respect to fuselage 11 because of the downward incline of the axis of rotation 30 of the propeller with respect to the centerline 31 of the fuselage. The upward incline of the center and side spars 38, 39 and 40 of the paraglide wing as indicated at 41 causes the upper portions of the inflated wing segments 48 and 49 to assume an attitude indicated at 50 which is approximately parallel to the longitudinal centerline 31 of fuselage 11. Thus, the air from the propeller tends to fill the wing segments 48 and 49 of the paraglide wing.

The center of gravity of the toy airplane is placed slightly forward of and well below the center of lift of the paraglide wing, so that when the toy airplane begins to slow down or to lose its thrust from its propeller, the toy airplane tends to pitch forward into a shallow diving glide and pick up speed and lift.

While the lifelike figure shown in the drawing is a witch, it will be understood that various other human, animal, or other forms can be used as the connecting structure between the paraglide wing and the fuselage. The appearance in general terms is to illustrate a character mounted on and riding the fuselage with a cape-like appearance extending outwardly and rearwardly of the shoulder portion of the character. The term "lifelike" used herein is not intended to limit the appearance of the connecting structure to a human form. Moreover, it is understood by those skilled in the art that toy airplanes tend to assume various attitudes while in flight and while at rest, and the terms used herein to indicate up, down, vertical, or other directions are to be interpreted broadly and without limitation when the toy airplane is in a tilted or inclined attitude.

While this invention has been described in detail with particular reference to a preferred embodiment thereof, it will be understood that variations and modifications can be effected within the spirit and scope of the invention as described hereinbefore and as defined in the appended claims.

I claim:

1. A toy airplane comprising an elongated fuselage, a tail assembly at one end of said fuselage and a propeller at the other end of said fuselage, said propeller having an axis of rotation inclined downwardly in a forward direction with respect to said fuselage, power means for rotating said propeller, a paraglide wing positioned over said fuselage with a center spar extending approximately in the same vertical plane as said fuselage and inclined upwardly in a forward direction with respect to said fuselage and side spars each connected at one end to the forward end of said center spar and diverging approximately equally on opposite sides rearwardly from said center spar, flexible sheet material connected to each of said center and side spars, an approximately flat connecting structure connected between said fuselage and the center spar of said paraglide wing with the plane of said approximately flat connecting structure extending parallel to said fuselage and said center spar.

2. The toy airplane of claim 1 and further comprising a lifelike figure mounted on said fuselage with said flat connecting structure forming at least a portion of the lifelike figure.

3. The toy airplane of claim 1 and wherein the side and center spars of said paraglide wing are located in a common plane and a cross brace is connected at its end portions and at its center portion to said side and center spars.

4. The toy airplane of claim 1 and further including landing gear connected to and extending downwardly from the forward portion of said fuselage, and further including a lifelike figure mounted on said fuselage with said flat connecting structure and said landing gear forming at least a portion of the lifelike figure.

5. The toy airplane of claim 1 and further including a lifelike figure mounted on said fuselage with said flat connecting structure forming a portion of said lifelike figure, and further including a projection mounted on and extending above said center spar and forming a portion of said lifelike figure.

6. A toy airplane comprising an elongated fuselage, a tail assembly at one end of said fuselage and a propeller at the other end of said fuselage, power means for rotating said propeller, a paraglide wing positioned over said fuselage, an approximately flat lifelike figure comprising connecting structure connected to said fuselage and to said paraglide wing with the plane of said connecting structure extending parallel to said fuselage, said lifelike figure including a body portion of the lifelike figure extending between said fuselage and said paraglide wing and a head portion extending above the paraglide wing.

* * * * *